United States Patent [19]

Morrish et al.

[11] Patent Number: 4,763,120

[45] Date of Patent: Aug. 9, 1988

[54] INTERLACED COLOR CATHODE RAY TUBE DISPLAY WITH REDUCED FLICKER

[75] Inventors: Andrew J. Morrish, Eastleigh; John H. Wells, Fareham, both of United Kingdom

[73] Assignee: International Business Machines Corporation, Armonk, N.Y.

[21] Appl. No.: 897,221

[22] Filed: Aug. 18, 1986

[30] Foreign Application Priority Data

Sep. 3, 1985 [EP] European Pat. Off. ..... 085306234.7

[51] Int. Cl.[4] ..... G09G 1/16

[52] U.S. Cl. ..... 340/748; 340/703; 340/789

[58] Field of Search ..... 340/792, 748, 750, 703, 340/789

[56] References Cited

U.S. PATENT DOCUMENTS

| | | | |
|---|---|---|---|
| 3,816,824 | 6/1974 | Thust et al. | 340/789 |
| 4,354,186 | 10/1982 | Groothuis | 340/703 |
| 4,521,774 | 6/1985 | Murphy | 340/791 |
| 4,549,172 | 10/1985 | Welk | 340/703 |

*Primary Examiner*—Marshall M. Curtis

*Attorney, Agent, or Firm*—Alexander Tognino; Marc D. Schechter; Jack M. Arnold

[57] ABSTRACT

An interlaced raster-scanned color cathode ray tube display in which flicker is reduced by temporally offsetting one of the colors (preferably red) so that normally even-field data for that color is displayed in the odd field and normally odd-field data for that color is displayed in the even field. The temporal shift can be either before or during storage of the bit patterns or during or after reading of the bit patterns.

The resulting positional shift of one scan line of the temporally shifted color is compensated for by using the static and/or dynamic convergence circuitry.

7 Claims, 4 Drawing Sheets

INTERLACED COLOR CATHODE RAY TUBE DISPLAY WITH REDUCED FLICKER

This invention relates to an interlaced color cathode ray tube display.

BACKGROUND OF INVENTION

Interlaced cathode ray tube displays have been popular in the past compared with non-interlaced CRT displays because they required slower circuits. Although circuit technology has improved so that non-interlaced CRT displays are technically feasible, interlaced displays will remain popular for some time because they use slower and therefore cheaper circuits.

For a given video data rate, interlaced display exhibit less flicker than non-interlaced displays, their shorter-persistence, more efficient phosphors also resulting in brighter displays. Nevertheless, interlaced displays can suffer from flicker and various proposals have been made to reduce flicker. U.S. Pat. No. 4,521,774 describes an arrangement in which control logic selects the field scan in which a particular picture element (pixel or pel) is to be displayed, the selection being made such that pel imbalance between the two fields is minimized. British Patent Specification No. 2 004 716 describes a technique for subjectively reducing the flicker of a bright area on the display by introducing bright points on adjacent scan lines.

The articles in the IBM Technical disclosure Bulletin at page 1675, Vol 21 No. 4 (September 1978), pages 1673 and 1674, Vol 21 No. 4 (September 1978), pages 1704 to 1706, Vol 23 No. 4 (September 1980), and pages 1548 and 1549, Vol 20 No. 4 (September 1977) all describe techniques for reducing flicker.

It is thus well recognized that flicker in an interlaced display can be reduced by equalizing the number of pels (or bright areas) on the two fields of the interlace. However the known techniques either require complicated logic or other circuit arrangements, and/or are limited in their application, that is to alphanumeric displays or graphic displays or even to a particular character font design.

SUMMARY OF INVENTION

An object of the present invention is to provide an interlaced cathode ray tube color display with reduced flicker using a technique which is applicable to a wide range of displays such as alphanumeric data, graphic image, teletex and high resolution television displays, that is any type of display in which the information to be displayed is stored in a store.

According to the invention, an interlaced cathode ray tube color display comprises a buffer containing bit patterns representing data to be displayed on a raster scanned interlaced color cathode ray tube and means for accessing said bit patterns to refresh said display and is characterized in means for temporally shifting the bit patterns relating to one of the primary colors so as to display data corresponding thereto in an opposite field to that in which they would otherwise be displayed.

The invention will now be particularly described, by way of example, with reference to the accompanying drawings, in which:

DESCRIPTION OF PREFERRED EMBODIMENTS

Figure 1:
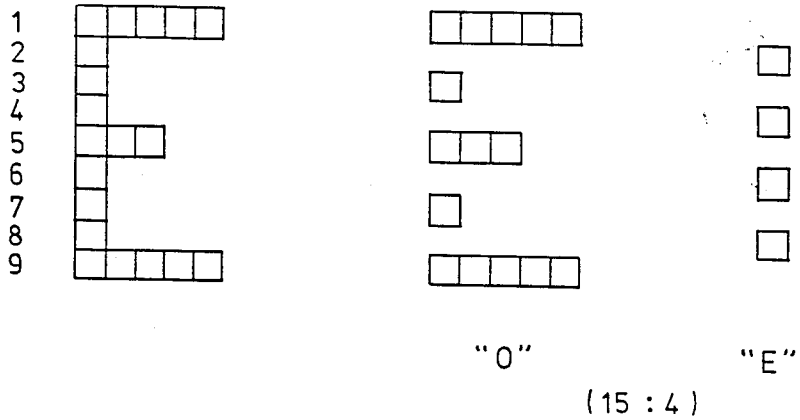
FIG. 1 illustrates how the character "E" is represented on an interlaced CRT display.

Referring now to FIG. 1, a character "E" is formed as a series of pels. The character E is shown since this is generally regarded as the worst character for inducing flicker. The reason can be seen by comparing the number of pels in the "odd" field with the number of pels in the even field. Thus rows 1, 3, 5, 7 and 9 constituting the odd field contain some 15 pels: rows 2, 4, 6 and 8 constituting the even field contain just 4 pels. This gives a ratio of 15:4, that is approximately 4:1. Such a ratio is likely to result in flicker. Other problems associated with interlaced displays include:

1. sagging of the extra high tension (EHT) and supply rails during the more heavily loaded field causing character break-up, that is line tearing and pairing,
2. visual amplification of jitter when using certain fill patterns, even those with balanced odd/even field loading causing a problem in very low alternating magnetic fields (an effect known as 'flimmer'),
3. apparent jitter due to horizontal lines close together on alternate fields.

These effects become worse at high brightness and are particularly bad when magenta, yellow and white are displayed as the blue and red phosphors are relatively low in efficiency and short in persistence. Green is not normally a problem as its efficiency is typically two or four times that of red and is of long persistence.

Figure 2:
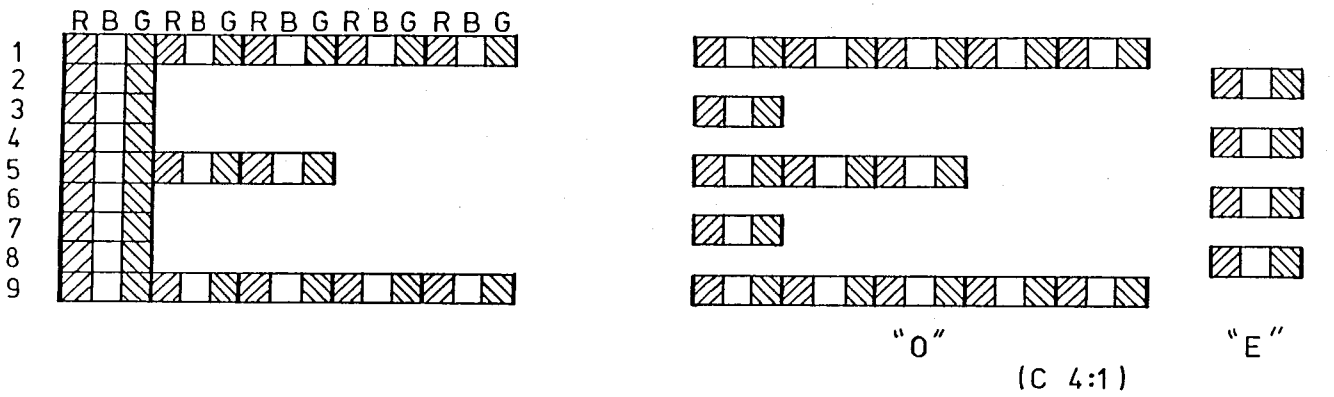
FIG. 2 is similar to FIG. 1 but serving to illustrate the effect of color, FIG. 3 serves to show the effect of using the present invention.

In FIG. 2, each pel consists of a red (R), blue (B) and green (G) triplet. Of course each red, blue or green pel will consist of a number of phosphor dots although they will be seen at normal viewing distances as a single spot, the color depending on which electron beams are activated. As will be seen in FIG. 2, the ratio of pels in the odd field is approximately four times the number in the even field.

In accordance with the present invention, these problems are mitigated by a temporal offset of one video channel preferably with a corresponding spatial correction of that video channel such that the chance of flicker is reduced for colors using the shifted channel. The natural integration mechanism of the human eye and brain combines the temporally-separated normally-coincident data.

Figure 3:
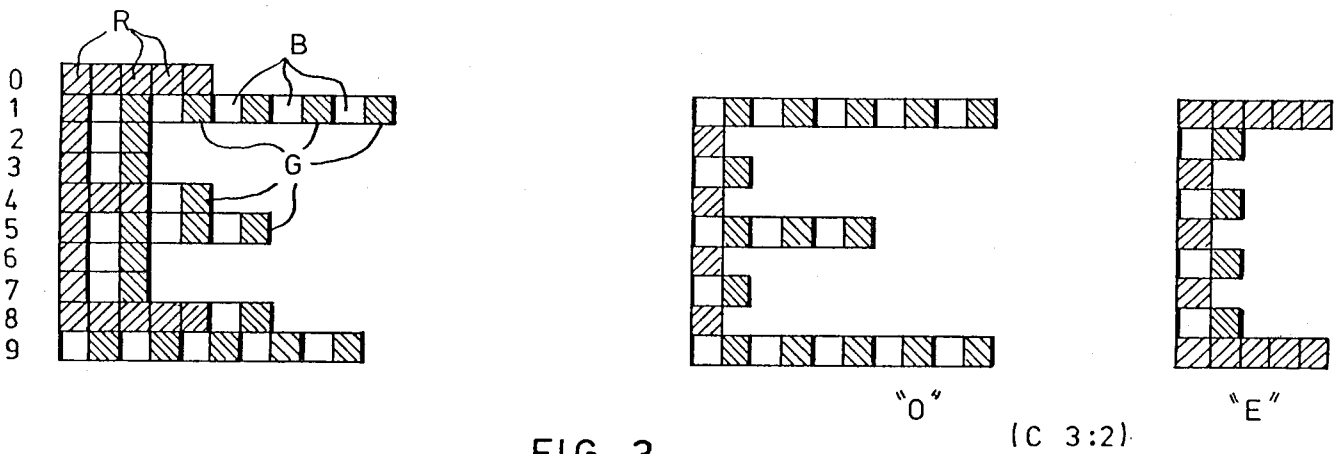

It is preferred if the red color is temporally offset because normally red phosphors have the shortest persistence—due to their lower efficiency. Green phosphors normally have the highest efficiency and longest persistence and the red and blue are in these circumstances chosen to be on opposing fields. The choice of which field is chosen to be common to green is made by considering the "combined persistence" of the secondary colors. Yellow flickers more than cyan so green is chosen to be on the opposite field to red. FIG. 3 schematically shows how the red bits (R) representing red pels are temporally displaced relative to the green (G) and blue (B) bits. As will be apparent later, this temporal separation can be made before or during loading of the bits into memory or after or during the bits are read from memory. Thus red bits (R) which would normally be displayed in the even field are in fact displayed in the odd field and red bits which would normally be displayed in the odd field are displayed in the even field. It will be seen that this technique reduces the ratio of odd to even pels to approximately 3:2. A single-pel-wide white horizontal line, in the absence of any further steps, would appear on close examination to be a single-pel-wide blue/green line on one field and a single-pel-wide red line on the other field. As the eye sees the displayed information refreshed on both fields, albeit in different colors, flicker will no longer be perceived. The apparent convergence error can be compensated for using either static or dynamic convergence methods using standard convergence techniques.

Figure 4:
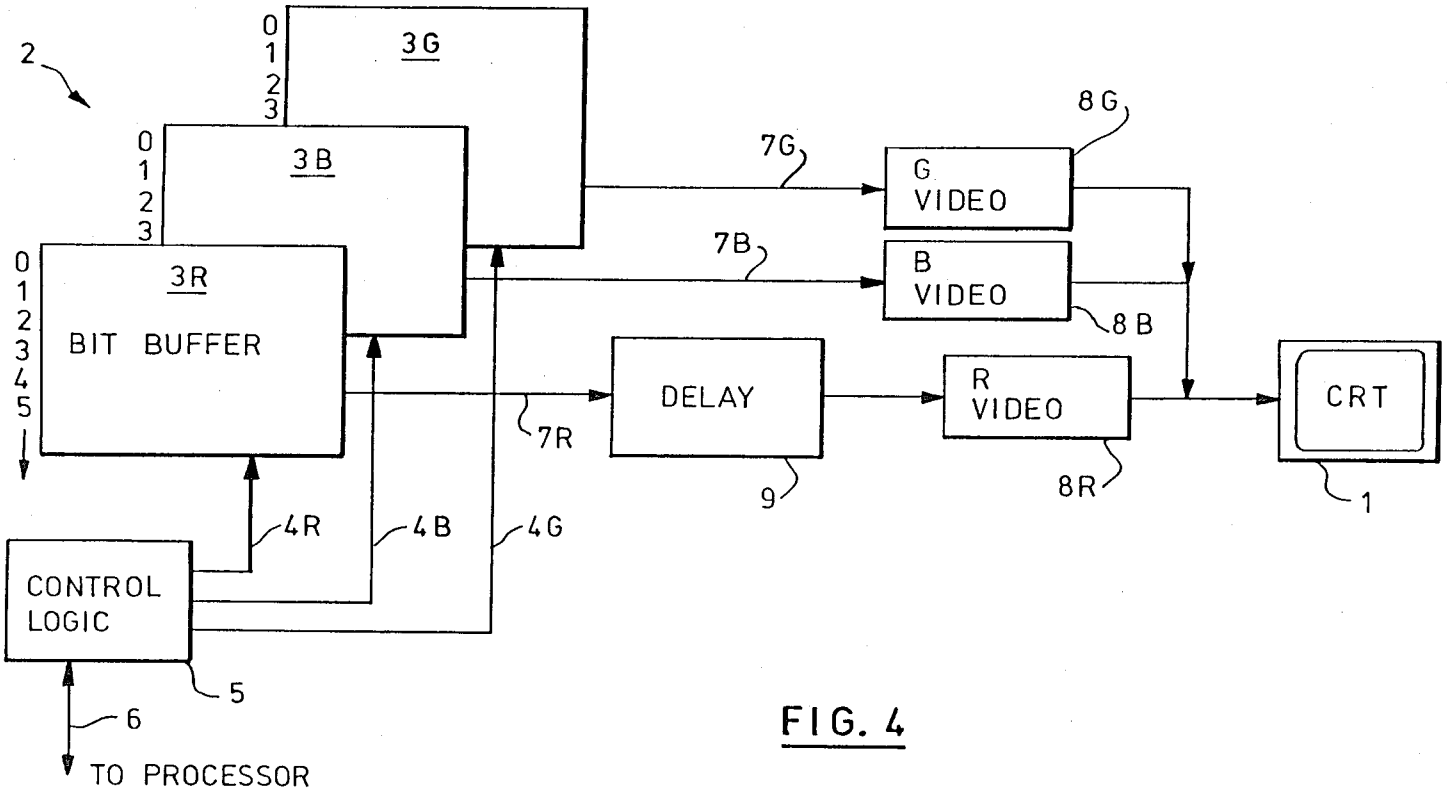
FIG. 4 illustrates the use of the invention in a graphic display using a bit buffer.

FIG. 4 is a block diagram of part of a bit-buffered color graphics display showing an implementation of the present invention. A bit map of a graphics image to be displayed on a raster-scanned interlaced cathode ray tube display 1 is stored in a bit buffer 2 consisting of at least three planes 3R, 3B, 3G associated with the red, blue and green images respectively. The bit patterns constituting the bit map are loaded into the plane 3R, 3B and 3G of the bit buffer 2 along lines 4R, 4B and 4G respectively by control logic 5 constituted, for example, by hard-wired logic or a microprocessor operating under program control. The control logic communicates with a remote data processor, not shown, by means of a communication line 6.

The control logic 5 includes refresh logic which periodically addresses the bit buffer 2 to obtain bit patterns for refreshing the CRT. The bit patterns contained in the bit buffer planes 3R, 3B and 3G are read out along lines 7R, 7B and 7G respectively to the red, blue and green video channels 8R, 8B and 8G respectively of the CRT 1.

In a conventional interlaced display, the even-numbered lines from the bit buffer 2 would be displayed in the even field, that is on even numbered lines on the CRT screen 1 and the odd-numbered lines in the odd field. However, in accordance with the invention, one of the channels is temporally offset. As represented schematically in FIG. 4 by delay 9, it is the red channel which would normally be offset. This offset may be performed in various ways. For example, the red bits may be loaded into the bit buffer 2 in a conventional manner and addressed in a conventional manner: in this even, the red bit pattern would be delayed by half a frame period (that is by one field period) so that odd line red bits are displayed on the even field and even line red bits on the odd field. Alternatively, the red bits can be offset by one line with respect to the blue and green bits as they are loaded into the bit buffer 2 by the control logic: in this case the red bit pattern would be addressed normally with no extra delay 9 in the red video channel. As a further alternative, the red bit pattern could be loaded into the bit buffer 2 normally with no offset: in this even the refresh logic could be arranged to address even-line red bits whilst it is addressing odd-line blue and green bits and to address odd-line red bits whilst addressing even-line blue and green bits (there would be no need for any extra delay in the red channel.

Figure 5:
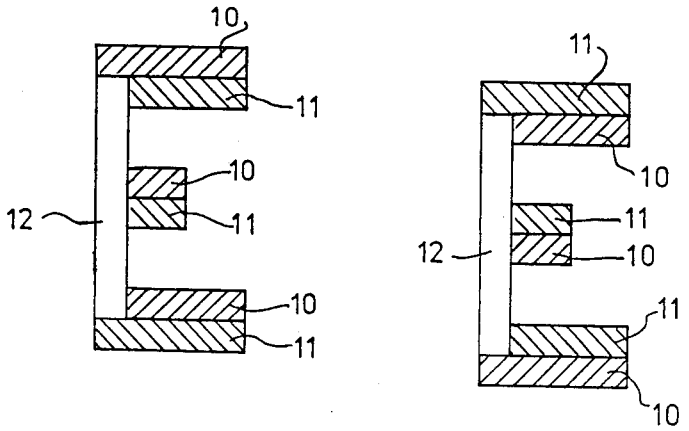
FIG. 5 illustrates the effect of not correcting for "misconvergence"

Whatever method is used, the convergence circuits are preferably used to bring red data back into convergence with corresponding blue and green pels on the screen. As shown in FIG. 5, the red offset can be either up or down. In FIG. 5, parts 10 represent red areas, parts 11 represent cyan (blue and green) areas and parts 12 represent white areas. By re-converging the red areas 10, the whole of the characters will be white.

Figure 6:
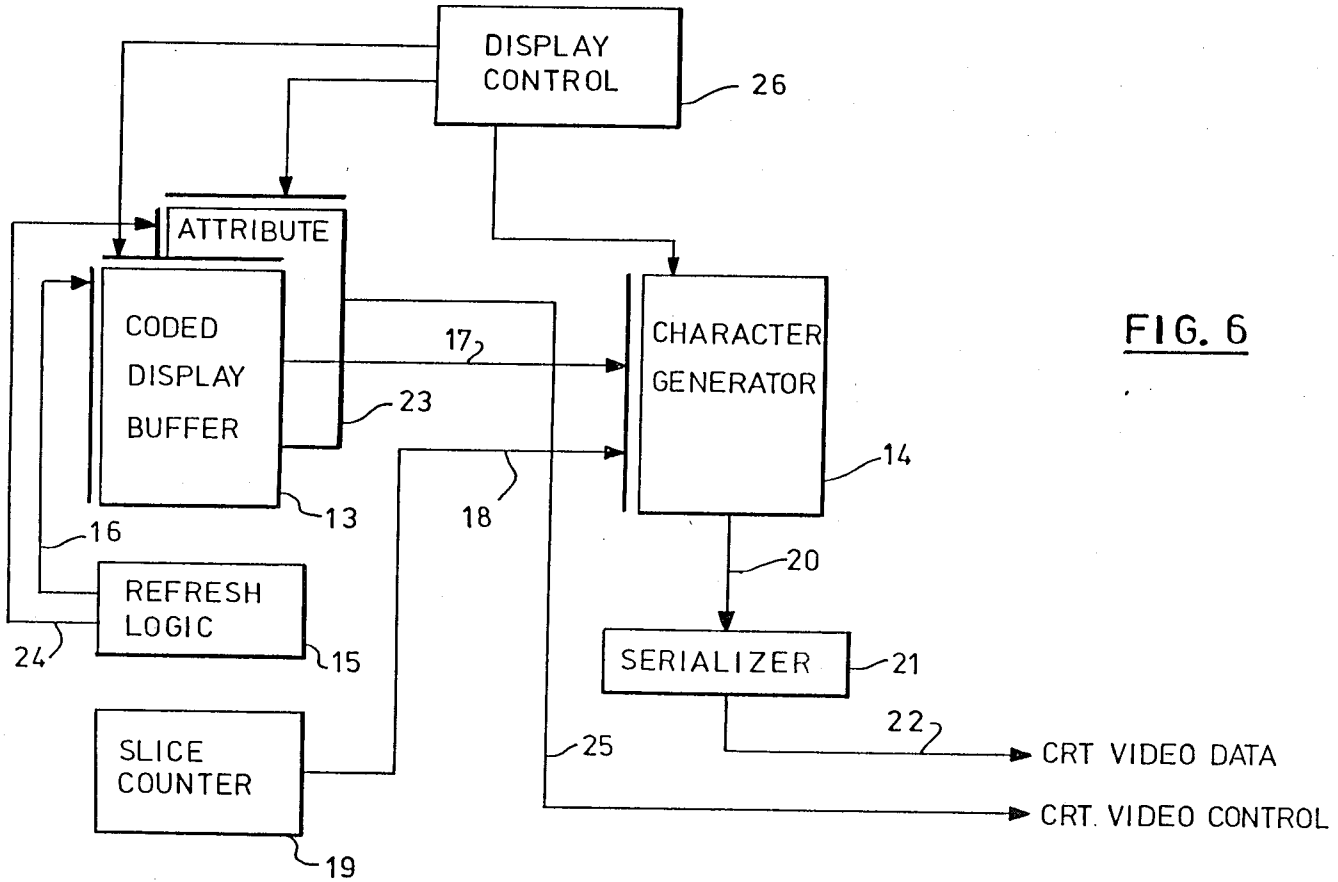
FIG. 6 illustrates the use of the invention in a character display using a character generator.

FIG. 6 is a block schematic of an alphanumeric display which includes a coded display buffer 13 in which are stored coded representations of alphanumeric characters or other symbols to be displayed on a cathode ray tube display, not shown. The codes within the display buffer 13 serve as pointers to the bit patterns needed to display the characters or symbols and which bit patterns are stored in a character generator memory 14. Each storage area in the buffer 13 is associated with a particular area on the CRT screen and the bit patterns for each character generator 14. During CRT refresh, refresh logic 15 accesses pointers from the buffer 13 on line 16 and these pointers in turn access the character generator 14 on line 17 together with a slice signal on line 18 from slice counter 19. The resulting bit patterns on line 20 are serialized in serializer 21 for onward transmission on line 22 to the CRT video circuits.

An attribute buffer 23 contains character attribute bytes which determine how each character is to be displayed, for example reverse video, blinking, color etc. The attribute buffer 23 is accessed by the refresh logic 15 along line 24 in syncronism with the display buffer 13. Attribute bytes appearing on line 25 are used by the CRT video circuits to control how the corresponding characters are to be displayed and can be used for example to control any necessary delays in the red video channel. Optionally and preferably, the character generator memory 14 is writable so that different bit patterns, representing for example different character sets or character graphics images (programmed symbols), can be loaded into it.

A display control 26, constituted for example by special purpose hard-wired logic or a microprogrammed microprocessor, controls the loading of data into the display buffer 13, the character generator 14 (if writable) and the attribute buffer 23. The display control 26 is able to communicate with a remote host processor, not shown.

As described so far, the display shown in FIG. 6 is conventional. However, in accordance with the present invention, it is modified to operate in a somewhat different manner to conventional displays. Normally-even-field information for the red data is displayed on the odd fields and normally-odd-field information for red data is displayed on the even fields. This temporal shifting of the red information is performed in a similar manner to the shift described with reference to FIG. 4. Thus the delay can be introduced after reading out the bit patterns for the red electron gun or addressing the "red" bit pattern in the character generator 14 can be modified. This latter implementation implies three storage planes within the character generator 14, one for each of the red, blue and green colors: in such an arrangement the "red" information could be stored differently. The temporal (and resulting positional) shift is corrected on the CRT display screen using the normal static and/or dynamic convergence unit.

What has been described is a technique which allows the reduction of flicker on an interlaced cathode ray tube display. Only simple (and therefore cheap) modifications to existing displays are required.

We claim:

1. An interlaced color cathode ray tube display comprising a buffer for containing bit patterns representing data to be displayed on a raster scanned interlaced color cathode ray tube, and means for accessing said bit patterns to refresh said display, and means for temporally shifting the bit patterns relating to one of the colors having a selected persistence characteristic so as to display data corresponding thereto in an opposite field to that in which they would otherwise be displayed, thereby reducing the flicker on said display.

2. A display as claimed in claim 1, in which the resulting positional shift of one scan line due to said temporal shifting of said one color data, resulting in an apparent convergence error, is compensated for by means of a dynamic and/or static convergence unit.

3. A display as claimed in claim 2, wherein said buffer includes means for storing the bit patterns in three planes of storage, one plane for each color, with bit patterns in the plane corresponding to said one color being temporally shifted with respect to the bit patterns in the other planes.

4. A display as claimed in claim 3, comprising means for temporally shifting said bit patterns as they are loaded into said buffer.

5. A display as claimed in claim 3, in which said temporal shifting means comprises means for storing data to be displayed in scan line increments, including means for storing bit patterns for said one color at locations separated from locations at which they would normally be stored by an increment of one scan line.

6. A display as claimed in claim 1, in which said temporal shifting means comprises a delay within the video channel associated with said one color and operable to delay signals passing therethrough by one field scan period.

7. A display as claimed in claim 2, in which red data are temporally shifted with respect to blue and green data.

* * * * *